United States Patent [19]

Nattrass

[11] Patent Number: 4,610,028

[45] Date of Patent: Sep. 2, 1986

[54] BULK CONTAINERS

[75] Inventor: Frank Nattrass, Harrogate, England

[73] Assignee: Nattrass-Hickey and Sons Limited, West Yorkshire, England

[21] Appl. No.: 759,092

[22] Filed: Jul. 25, 1985

[30] Foreign Application Priority Data

Aug. 14, 1984 [GB] United Kingdom ..... 8420600

[51] Int. Cl.[4] ..... B65D 33/14; B65D 88/16

[52] U.S. Cl. ..... 383/7; 383/17; 383/24; 383/117; 383/119

[58] Field of Search ..... 383/6–8, 383/24, 17, 41, 117, 119; 222/105, 185

[56] References Cited

U.S. PATENT DOCUMENTS 4,207,937 6/1980 Sandeman et al. ..... 383/17
4,362,199 12/1982 Futerman ..... 383/17
4,479,243 10/1984 Derby et al. ..... 383/6 X

FOREIGN PATENT DOCUMENTS 2727411 5/1979 Fed. Rep. of Germany ..... 383/17
1525994 9/1978 United Kingdom ..... 383/117
2116143 9/1983 United Kingdom ..... 383/17

*Primary Examiner*—William Price
*Assistant Examiner*—Sue A. Weaver
*Attorney, Agent, or Firm*—Henry Sternberg; Bert J. Lewen

[57] ABSTRACT

A flexible bulk container has a side wall structure 1 formed from a length of tubular woven fabric comprising a base fabric and a plurality of parallel reinforcing bands such as 2 to 5 integrally woven with the base fabric and extending parallel to the tube axis. A bottom 26 is stitched to the side wall structure at one end of the fabric length and a top wall structure 24 may be secured at the other end of the fabric length. The container has a plurality of lifting loops 20 to 23 at the top end of the fabric length, each lifting loop being formed by cutting back a portion of the base fabric alongside each of two adjacent reinforcing bands (e.g. 3 and 4) to leave parts of the bands projecting from the base fabric, and securing together the free ends of the projecting parts to form the loop (e.g. 20). One of the projecting parts may be twisted through 180° before the free ends are joined together.

5 Claims, 4 Drawing Figures

BULK CONTAINERS

Figure 1:
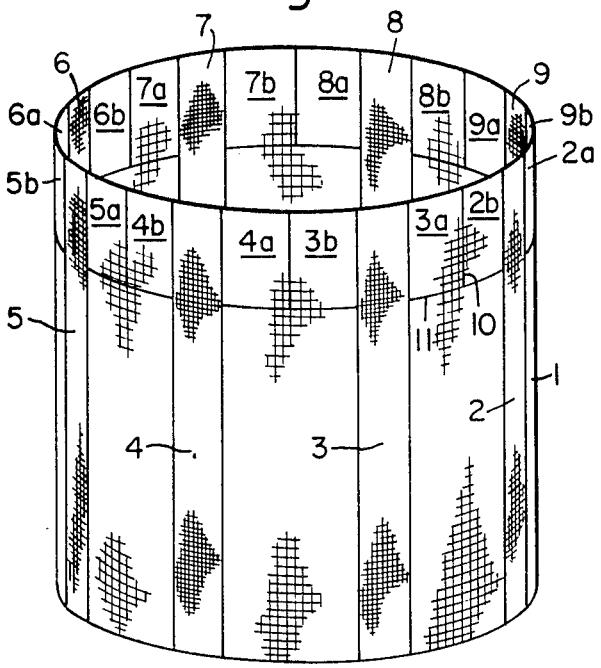

This invention relates to flexible bulk containers such as are used in the storage and transport of materials in granular, powder and other particulate forms.

Such containers are generally in the form of large bags or sacks which are often required to carry loads of up to one tonne or more with considerable safety margin above this working load. The containers are commonly made from woven fabric, particularly woven polypropylene or other suitable synthetic material. There have in the past been many proposals for the manufacture of such containers, and also many proposals for providing the containers with lifting loops at the upper part of the container. In the most commonly used construction the lifting loops are loops of high strength webbing which are stitched to the side walls of the container, desirably so that there is reinforcement in the area where stitching occurs. For example, the side wall fabric may be folded so that each loop is stitched to a plurality of thicknesses of material. In another known arrangement each loop may be stitched to the side wall in the region where the side wall fabric is reinforced.

The points of attachment of the lifting loops to the side walls are generally regions of high stress concentration, and despite reinforcement the areas surrounding these connections are the commonest failure areas for these containers. This is particularly the case where the container is mishandled, for example lifted or pulled with only a single loop of the container engaged by the lifting or pulling means. A number of attempts have been made to design constructions which provide a loop structure such that damage of this nature is positively avoided, but it is extremely difficult to obtain a satisfactory solution at an economic cost. The object of the invention is to provide a container with improved stress distribution into the side wall structure.

According to the invention a flexible bulk container comprises a side wall structure formed from a length of tubular woven fabric, the fabric comprising a base fabric and a plurality of parallel reinforcing bands woven integrally with the base fabric and extending parallel to the axis of the tube, a bottom stitched to the side wall structure at one end of the length of fabric, and a plurality of lifting loops at the other end of the length of fabric, each lifting loop being formed by cutting back a portion of base fabric alongside each of two adjacent reinforcing bands to leave parts of these bands projecting from the base fabric, and securing together the free ends of the projecting parts.

It will be seen that each loop is formed by a continuous extension of two adjacent reinforcing bands, and that those bands are woven integrally with the base fabric. Thus, there is no stitched connection whatsoever between the individual lifting loops and the side walls of the container and, apart from avoiding the operation of stitching the loops to the side walls, this arrangement avoids the stress concentrations at the stitching points and significantly improves the distribution of stress from the lifting loops over the container side wall fabric. Furthermore, the use of tubular woven fabric, which has continuous weft threads extending around the full circumference of the container, leads to an additional improvement in stress distribution around the container side wall structure.

Preferably one of the projecting parts is twisted through 180° before being secured to the other projecting part.

The imparting of 180° twist to one of the projecting parts forming each lifting loop is found, most surprisingly, materially to improve even further the stress distribution, and the introduction of this twist renders the loop substantially fully resistant to damage and tearout from the container even when the container with its rated load is lifted or pulled with only a single loop engaged by the lifting or pulling means. A solution to the pull-out problem is thus provided in an extremely simple and inexpensive manner, and additionally the container construction itself is relatively cheap due to the use of tubular woven fabric which avoids the necessity of having to form side seams between adjacent panels of a side wall structure.

The container may be open or, more preferably, may be closed by a top stitched to the side wall structure and adjacent to the lifting loops opposite to the bottom of the container. The top may be formed with any suitable opening and/or skirt arrangement and the bottom may be formed with any suitable discharge arrangement. If required the container may be formed with an inner, impervious, liner within which the load is contained, to give added protection against the ingress of moisture and also to prevent fine material escaping from the container.

The portions of the base fabric that are cut back adjacent to each reinforcing band are desirably folded around the respective band and stitched to the band in order to protect the band from chafing and to give added strength to the lifting loop.

The invention is particularly suitable for a container having four lifting loops, in which case the tubular woven fabric will have eight parallel reinforcing bands. Four loop bags are probably the most common in the field of bulk containers, and an additional advantage provided by the invention is that such containers can be made with four stitching operations to sew together the ends of adjacent projecting parts, rather than with eight stitching operations as are needed conventionally when each lifting loop is stitched at each end to the side wall structure of the container.

In another embodiment tubular woven fabric having four reinforcing bands can be formed into a container having two lifting loops.

Formation of a tubular woven fabric having integral reinforcing bands extending parallel to the axis of the tube can readily be achieved by conventional weaving techniques. The reinforcing bands may be provided, for example, by the cramming of warp threads in the region of the reinforcing band, i.e. by making the warps per centimeter in the reinforcing band regions greater than the number of warps per centimeter in the base fabric of the tube. Alternatively, the reinforcing bands may incorporate warp yarn of a higher tensile strength than the warp yarns of the base fabric. These higher strength yarns may replace entirely the warp yarns used for the base fabric, or they may be used in addition to those warp yarns so that each reinforcing band will incorporate both base fabric warp yarns and higher strength warp yarns.

In a preferred arrangement the material of the tube may be woven fabric having polypropylene warp and weft threads interwoven in any appropriate weaving pattern, usually smooth woven, although twill, basket and rib weaves may also be used. Interwoven with the polypropylene weft threads in the regions of the reinforcing bands are additional warp threads having a higher tensile strength than the base polypropylene warp threads. The reinforcing threads may be made from any suitable natural fibre or from yarn of synthetic or semi-synthetic polymer, such as polyester, polyamide, polyolefin or polyacrylic. The higher strength warp threads may alternatively also be of polypropylene, which may be of a higher count than the base polypropylene threads or may be a thread similar to the base thread which has been treated, i.e. by fibrillation, in order to increase its tensile strength. The suggested materials given in this paragraph do not constitute an exhaustive list, and other materials that can be used will be apparent to those skilled in the art.

In order that the invention may be better understood the manufacture of a specific embodiment of container in accordance with the invention will now be described in more detail, by way of example only, with reference to the accompanying drawings in which FIGS. 1 to 4 show successive stages in the manufacture of a container.

Figure 2:
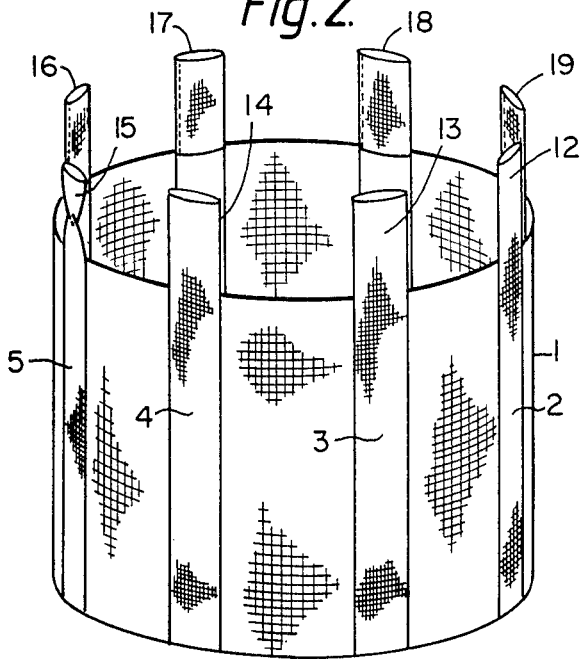
Figure 3:
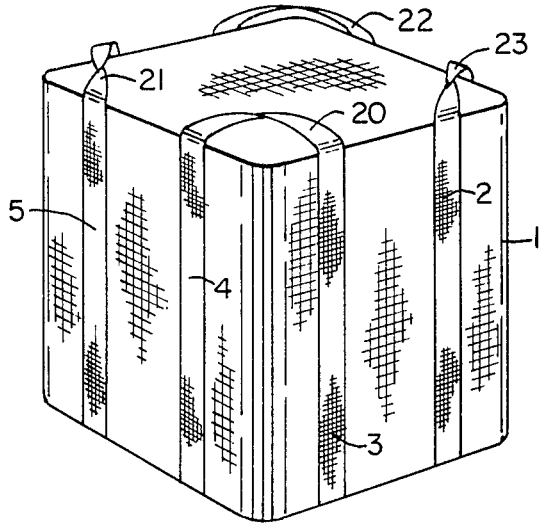
Figure 4:
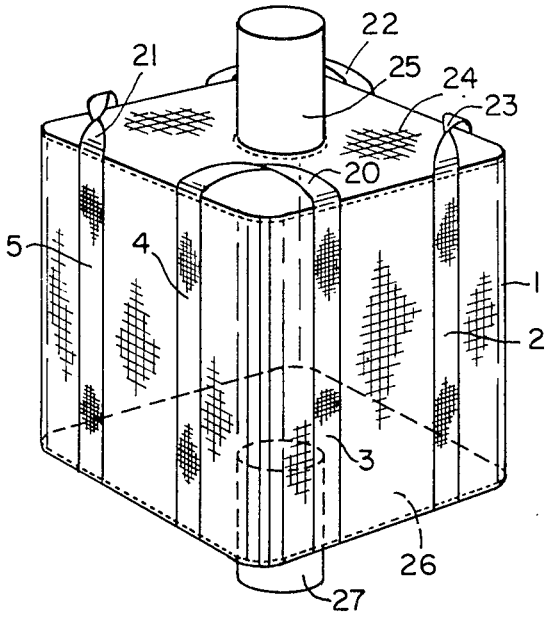

FIG. 1 is a perspective view of a length of tubular woven fabric used to form a specific embodiment of the container in accordance with the invention;

FIG. 2 is a perspective view of the length of tubular woven fabric according to FIG. 1 after portions thereof have been cut along lines indicated in FIG. 1, and folded, FIG. 3 is a perspective view of the length of tubular woven fabric shown in FIG. 2, with square top and bottom portions attached forming a bulk container according to the invention having lifting loops, and FIG. 4 is a pespective view of the bulk container of FIG. 3 including filling and discharge means at top and bottom.

Referring now to FIG. 1 this shows a blank in the form of a length of tubular woven fabric. The fabric comprises a base fabric 1 and eight parallel reinforcing bands 2 to 9 woven integrally with the base fabric and extending parallel to the axis of the tube. In order to form lifting loops for the container, sections of base fabric lying between adjacent reinforcing bands at one end of the length of fabric are cut as shown in FIG. 1. Thus, between each pair of adjacent bands a first cut 10 is made mid-way between the two bands and extending parallel to the bands, and from the bottom of that cut a transverse cut 11 is made extending circumferentially of the fabric to terminate adjacent to each of the two respective bands. The result of these cuts is to leave a section of each reinforcing band to which is attached two flaps, one lying to each side of the band. Thus, band 2 has attached flaps 2*a* and 2*b*, band 3 has attached flaps 3*a* and 3*b* and so forth. the two flaps associated with each band are then folded around the band and stitched to it in order to form a protective covering for the band, whereupon the blank takes on the form shown in FIG. 2. In this form, parts 12 to 19 of the reinforcing bands 2 to 9 project from the base fabric in a direction parallel to the axis of the tube.

In order to form lifting loops the parts 12 and 13 are secured together, parts 14 and 15 are secured together as are parts 16 and 17 and parts 18 and 19. Before such securing, however, in a first embodiment of the invention one part of each pair is twisted through 180° as shown, for example, by the twisting of part 15 in FIG. 2. The ends of the twisted and untwisted parts are then overlapped and the overlapping region is stitched to form a loop as shown in FIG. 3. When each loop has been completed the 180° twist that was present in one part forming the loop is taken up through the length of the loop so that the twist therein is gradual along its length.

After formation of the loops 20 to 23 a square top 24 is stitched to the side wall structure at the end adjacent the loops, which will of course be the top of the container. The top may be formed with any suitable filling arangement 25. Similarly, a square bottom 26 is stitched to the side wall structure at the opposite end of the length of fabric, and the bottom may be formed with a suitable discharge arrangement 27. If required, the container may be provided with an impervious inner liner.

The simplicity of manufacture of the container will be appreciated from the foregoing description. The strength of the base fabric and of the reinforcing bands forming the lifting loops are, of course, chosen according to the rated load of the container in order to give an appropriate factor of safety, usually required to be at least 5:1. Stress distribution in the side wall structure is found to be excellent. Surprisingly, it has been found that a container so manufactured is capable of lifting the rated load with just one of the four loops engaged by the lifting means. It is the presence of 180° twist in each lifting loop that leads to this result, and of course the described method of manufacturing the container makes it extremely easy for this twist to be inserted.

In a second embodiment of the invention each part 12 to 19 of the reinforcing bands is left untwisted, and adjacent parts 12, 13, 14, 15, 16, 17 and 18, 19 respectively are stitched together at their ends in the untwisted condition. The resulting container has excellent stress distribution in the side wall structure, but is somewhat less resistant to failure if lifted on one loop than is the case in the first embodiment wherein the loops are twisted.

The examples described have been of containers having four lifting loops, but the invention may also be applied to a container having only two loops. In this case the tubular fabric will be woven to have four reinforcing bands, upper parts of adjacent pairs of which are then joined to form the lifting loops, with one part of each pair twisted if required.

In either embodiment the top and bottom of the container need not be square, but may be circular or of any other suitable shape. Furthermore, the base may be formed from a continuation of the tubular woven fabric used for the side wall structure, suitably cut, folded and stitched to the required shape. A base formed in this way may replace, or supplement, a separate fabric base stitched into position.

I claim:

1. A flexible bulk container comprising a side wall structure formed from a length of tubular woven fabric, the fabric comprising a base fabric and a plurality of parallel reinforcing bands woven integrally with the base fabric and extending parallel to the axis of the tube, a bottom stitched to the side wall structure at one end of the length of fabric, and a plurality of lifting loops at the other end of the length of fabric, each lifting loop being formed by cutting back a portion of base fabric alongside each of two adjacent reinforcing bands to leave parts of these bands projecting from the base fabric, and securing together the free ends of the two projecting parts.

2. A flexible bulk container according to claim 1 in which one of the projecting parts is twisted through 180° before being secured to the other projecting part.

3. A flexible bulk container according to claim 1 in which the portions of the base fabric that are cut back adjacent to each reinforcing band are folded around and stitched to the respective band.

4. A flexible bulk container according to claim 1 in which the tubular woven fabric has eight parallel reinforcing bands, and projecting parts of adjacent pairs are joined together to form four lifting loops.

5. A flexible bulk container according to claim 1 in which the fabric is of polypropylene warp and weft base threads, and each reinforcing band comprises additional warp threads interwoven with the weft base threads and having a higher tensile strength than the base warp threads.

* * * * *